US006206585B1

(12) United States Patent
Walter

(10) Patent No.: US 6,206,585 B1
(45) Date of Patent: Mar. 27, 2001

(54) FILM DROP-OFF APPARATUS AND METHOD

(75) Inventor: Joanne S. Walter, Alpharetta, GA (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/272,040

(22) Filed: Mar. 18, 1999

(51) Int. Cl.[7] ..... G03D 17/00
(52) U.S. Cl. ..... 396/564; 345/961
(58) Field of Search ..... 396/564; 355/27, 355/40, 41; 358/487; 235/379–381; 345/344, 961, 978; 705/35, 401

(56) References Cited

U.S. PATENT DOCUMENTS

| | | | | |
|---|---|---|---|---|
| D. 251,649 | | 4/1979 | Devin et al. | D6/188 |
| 4,803,348 | | 2/1989 | Lohrey et al. | 235/381 |
| 5,113,351 | * | 5/1992 | Bostic | 396/564 |
| 5,499,707 | | 3/1996 | Steury | 194/217 |
| 5,652,936 | | 7/1997 | Klees et al. | 396/564 |
| 5,666,215 | * | 9/1997 | Fredlund et al. | 358/487 |
| 5,667,288 | | 9/1997 | Kang | 312/211 |
| 5,737,729 | | 4/1998 | Denman | 705/401 |
| 5,799,219 | * | 8/1998 | Moghadam et al. | 396/564 |

* cited by examiner

*Primary Examiner*—D. Rutledge
(74) *Attorney, Agent, or Firm*—Paul W. Martin

(57) ABSTRACT

A film drop-off apparatus which minimizes lost film. The apparatus includes a computer; a display controlled by the computer which displays instructions to a customer, including photo delivery options during a film processing transaction; an input device controlled by the computer which records a customer choice for a photo delivery location; and a printer controlled by the computer which prints information identifying the photo delivery location on a film envelope.

6 Claims, 4 Drawing Sheets

FILM DROP-OFF APPARATUS AND METHOD

BACKGROUND OF THE INVENTION

The present invention relates to photo processing and more specifically to a film drop-off apparatus and method.

Film drop-off kiosks are commonplace in grocery stores and other retail establishments. A customer removes a film drop envelope from an envelope bin, fills out the envelope with name and address information, puts film to be developed into the envelope, and drops the envelope into a storage bin for pickup by photo processing personnel. More sophisticated film drop-off kiosks include computer interfaces and provide additional features for customers.

One of a customer's biggest fears with any drop-off system is that the film might be lost. Therefore, it would be desirable to provide a film drop-off kiosk and which minimize the possibility of losing film.

SUMMARY OF THE INVENTION

In accordance with the teachings of the present invention, a film drop-off apparatus and method are provided.

The apparatus includes a computer; a display controlled by the computer which displays instructions to a customer, including photo delivery options during a film processing transaction; an input device controlled by the computer which records a customer choice for a photo delivery location; and a printer controlled by the computer which prints information identifying the photo delivery location on a film envelope.

A film processing method includes displaying instructions to a customer, including photo delivery options during a film processing transaction; recording a customer choice for a photo delivery location; printing information identifying the photo delivery location on a film envelope; and dispensing the envelope.

The film processing method may also include reading the information identifying the photo delivery location on the film envelope at a location; and if the location is not the photo delivery location on the film envelope, delivering the envelope to the photo delivery location on the film envelope.

It is accordingly an object of the present invention to provide a film drop-off apparatus and method.

It is another object of the present invention to provide a film drop-off kiosk with a computer interface which prints information on film envelopes, including the store name and address where the kiosk is located.

It is another object of the present invention to provide a film drop-off method which minimizes the chance that developed film will be lost or delivered to a wrong store.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
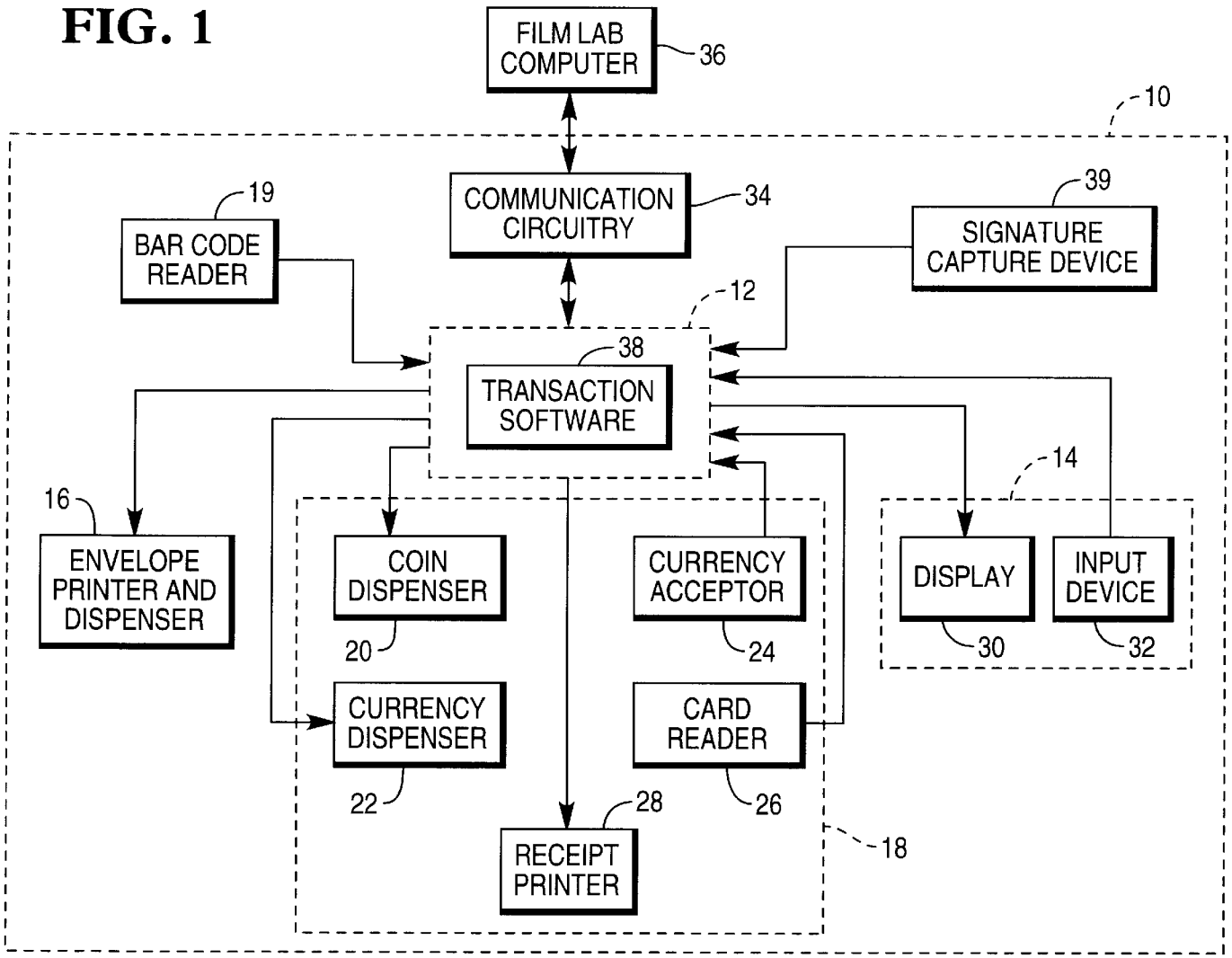
FIG. 1 is a block diagram of the film processing system, including a film drop-off kiosk of the present invention.

Referring to FIG. 1 of the drawings, there is shown therein a film drop-off apparatus 10 in a supermarket. Apparatus 10 primarily includes processor 12, interface modules 14, envelope printer and dispenser 16, payment modules 18, and bar code reader 19.

Processor 12 automates the functions of apparatus 10. For this purpose, processor 12 executes transaction software 38 which guides customers through film processing transactions, records customer choices, and accepts customer payment. Software 38 manages different delivery options available to a customer and helps customers track the status of film processing and delivery. In particular, software 38 includes a list of store identifiers and location information for delivery of developed film.

Interface modules 14 include display 30 and input device 32. Display 30 displays information to customers to assist them in completing a film processing transaction. Display 30 may by a cathode ray tube (CRT) or liquid crystal display (LCD).

Input device 32 records customer choices and other information in order to complete the transaction. Recording customer information further minimizes risk of loss, particularly the risk of loss associated with film envelopes with handwritten information. Input device 32 may be a keyboard.

Alternatively, interface modules 14 may be combined as a touch screen.

Envelope printer and dispenser 16 prints important customer and delivery information on film envelopes. For example, envelope printer and dispenser 16 prints customer name and address information recorded by input device 32.

Under the method of the present invention, envelope printer and dispenser 16 additionally prints store identification information to assist the film laboratory with delivery of developed film to correct stores. This is especially helpful when film has inadvertently been delivered to an incorrect store. The store identification information on the envelope allows the photo processing lab to eventually get the envelope to the correct store. This information minimizes the possibility that the envelope is discarded as unclaimed.

Payment modules 18 allow customers to pay for film developing when they drop the film off. Payment modules 18 include coin dispenser 20, currency dispenser 22, currency acceptor 24, card reader 26, and receipt printer 28.

Bar code reader 19 allows customers to scan bar code labels on their receipts or film envelopes in order to track the status of their film. Film processing personnel periodically make status entries into film laboratory computer 36. Processor 12 downloads status information upon reading of bar code labels.

Coin dispenser 20 and currency dispenser 22 provide change to customers.

Currency acceptor 24 accepts paper currency from customers as payment.

Card reader 26 reads payment cards used by customers to make payment. Card reader 26 may include a magnetic stripe reader. Card reader 26 may also include a smart card reader or combination credit and smart card reader.

Receipt printer 28 prints customer receipts after payment has been made. Also, receipt printer 28 prints a bar code on the receipt. The customer may read the bar code using bar code reader 19 to determine the status of the film.

Communication circuitry 34 facilitates delivery of order status information to apparatus 10 upon customer inquiry. Communication circuitry 34 is a communication interface between processor 12 and film laboratory computer 36. In a first configuration, communication circuitry 34 may include a modem for communicating with an external film laboratory computer 36. In a second configuration, communication circuitry 34 may include an in-store processor, a network connection between the in-store processor and processor 12, and a modem connection between the in-store processor and an external film laboratory computer 36. In a third configuration, film laboratory computer 36 may be an in-store computer since some supermarkets have their own film processing labs. In this configuration, communication circuitry 34 includes a network connection between film laboratory computer 36 and processor 12, with or without an intermediately located in-store processor.

Figure 2:
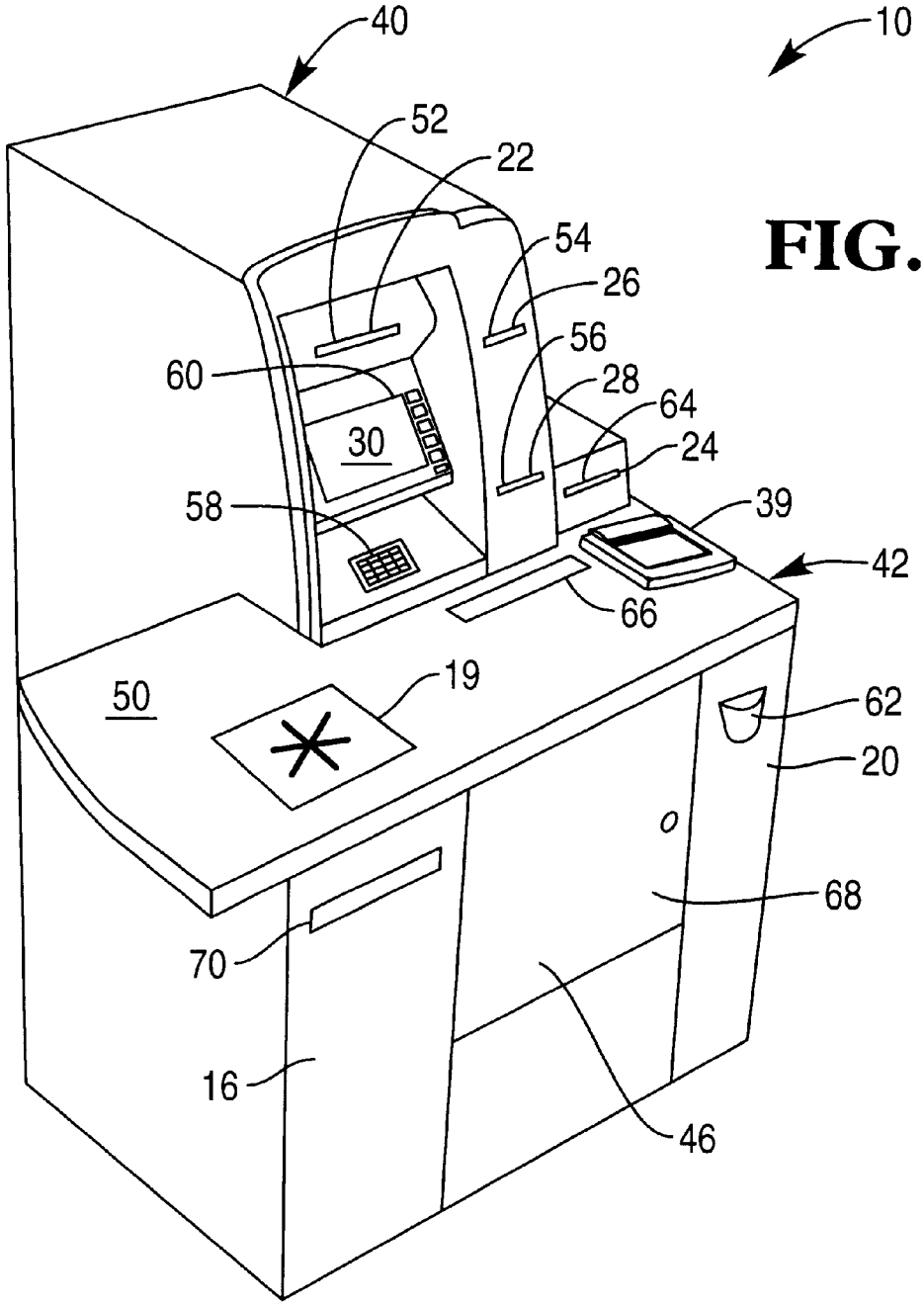
FIG. 2 is a perspective view of a first film drop-off kiosk.

With reference to FIG. 2, a first film drop-off kiosk 10 is shown in more detail.

Film drop-off apparatus 10 may be built upon a self-service financial terminal for performing banking transactions, also known as an automated teller machine (ATM). The banking transactions include cash withdrawal from a banking account and cash deposit into the account. The present invention also envisions a more simple platform, one which does not include such banking functions.

Film drop-off apparatus 10 primarily includes self-service terminal 40 and cabinet 42.

Self-service terminal 40 contains processor 12, currency dispenser 22, card reader 26, receipt printer 28, display 30, input device 32, and communication circuitry 34.

Preferably, self-service terminal 40 is an NCR multi-function ATM which executes software for guiding a customer through a film processing transaction. The software may also guide a customer through a banking transaction as part of the film processing transaction or independently of a film processing transaction. For example, customers may wish to pay for film processing transactions and receive money from their bank accounts to take with them.

Bar code reader 19 may be an NCR model 7880 bar code scanner.

Currency dispenser 22 ejects currency through slot 52.

Card reader 26 accepts cards through slot 54.

Receipt printer 28 ejects a receipt through slot 56.

Input device 32 includes keypad 58 and function keys 60.

Cabinet 42 fastens to self-service terminal 40 and includes envelope printer and dispenser 16, coin dispenser 20, currency acceptor 24, envelope collection bin 46, and work surface 50.

Envelope printer and dispenser 16 ejects an envelope with printed information thereon through slot 70.

Coin dispenser 20 ejects change coins into coin receptacle 62.

Currency acceptor 24 accepts currency through slot 64.

Envelope collection bin 46 receives envelopes containing undeveloped film through slot 66. Store personnel regularly empty envelope collection bin 46 through door 68.

Work surface 50 forms the top of cabinet 42.

Figure 3:
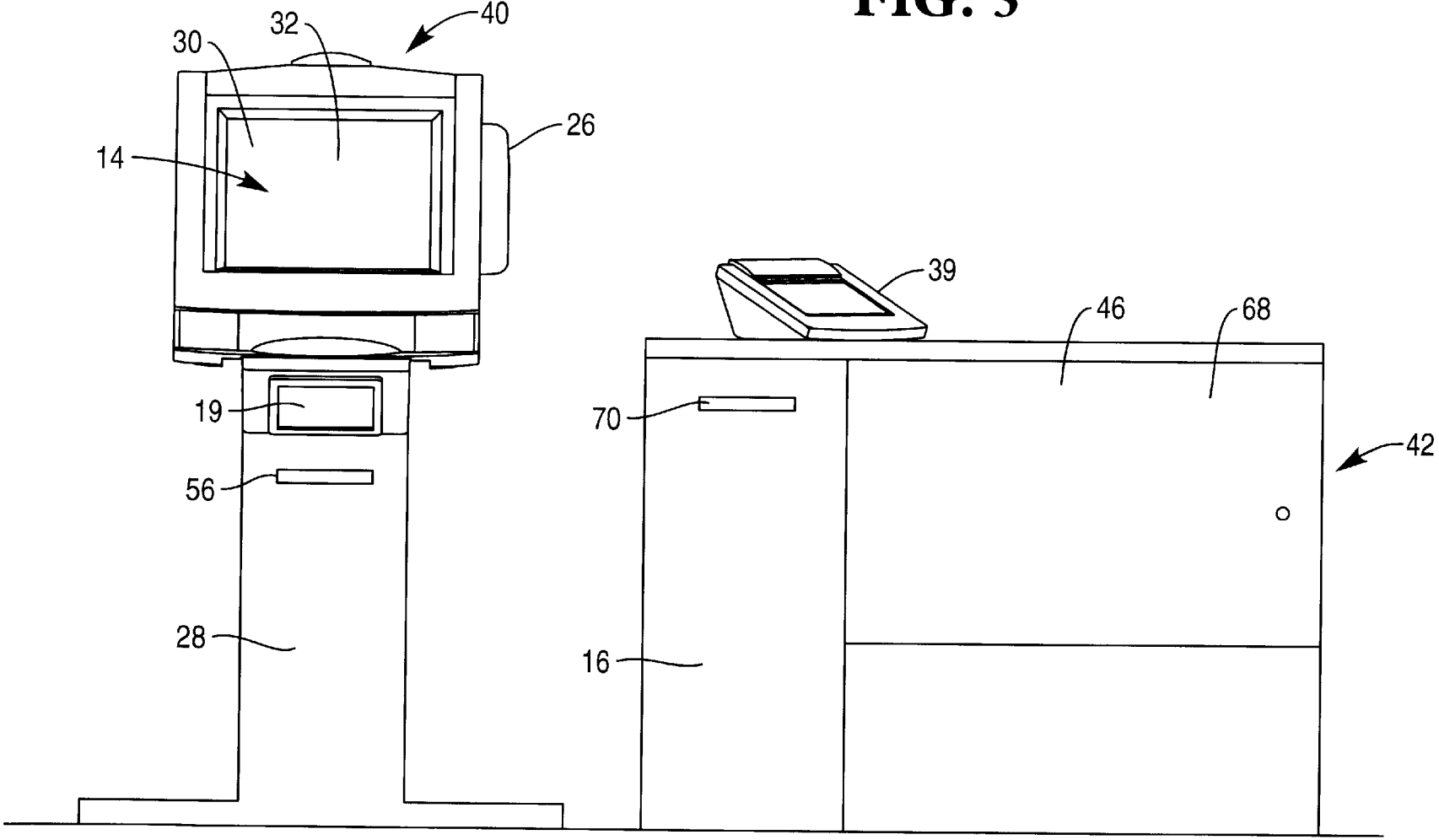
FIG. 3 is a perspective view of a second film drop-off kiosk.

With reference to FIG. 3, a second film drop-off kiosk 10 is shown in more detail.

Film drop-off apparatus 10 may be built upon a more simple platform, including an NCR 7401 self-service terminal.

The second drop-off apparatus 10 is otherwise similar to the first, except that it is illustrated without cash handling capability. It does not include coin dispenser 20, currency dispenser 22, and currency acceptor 24. Thus, credit card transactions are preferred. Also, interface modules 14 include a touch screen.

Figure 4:
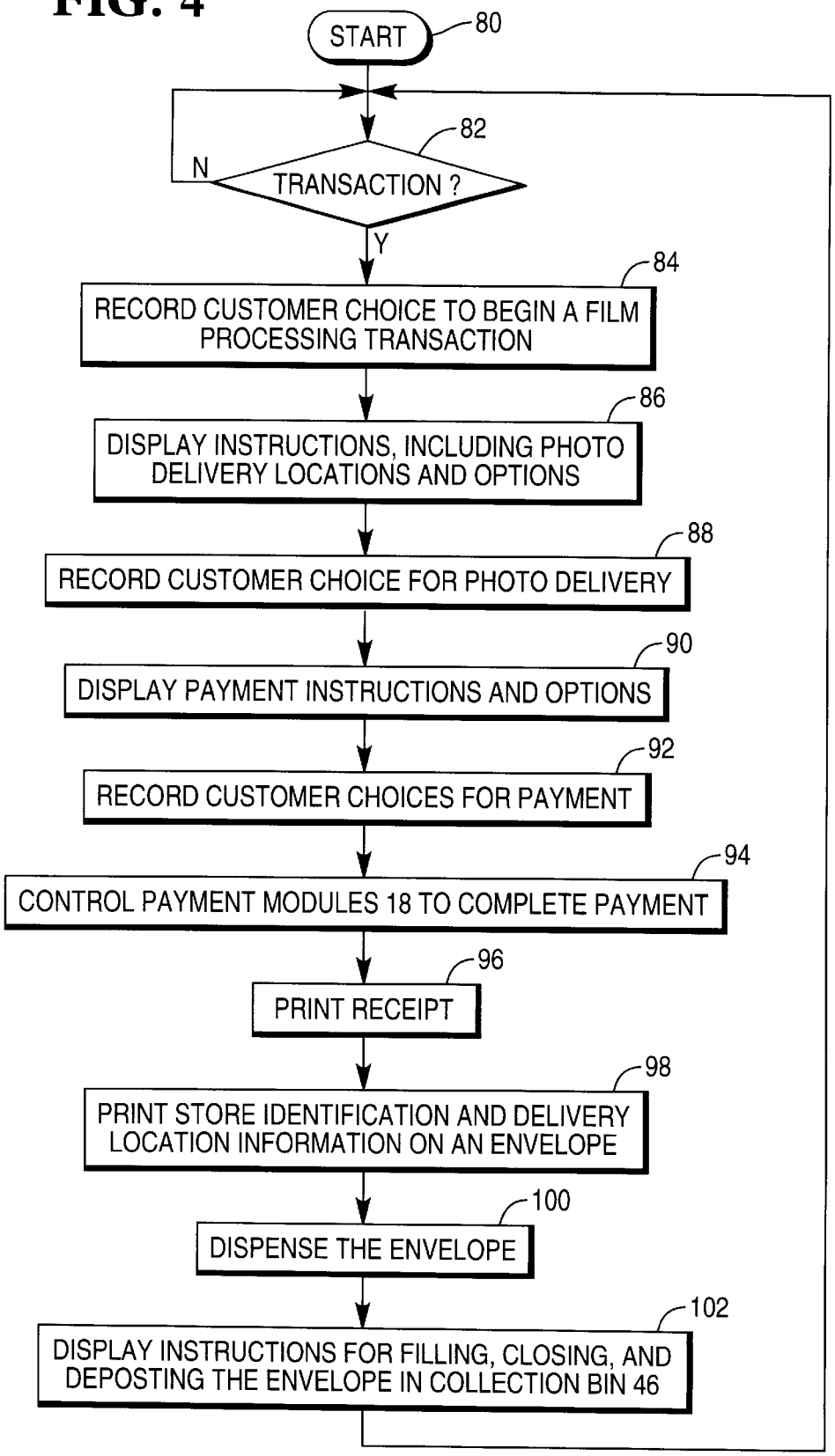
FIG. 4 is a flow diagram illustrating the method of the present invention.

Turning now to FIG. 4, the film processing method of the present invention is illustrated in more detail beginning with start 80.

In order to use film drop-off apparatus 10, a customer approaches the counter 14 with undeveloped film.

In step 82, processor 12 causes display 30 to display an opening screen with instructions for starting a transaction and processor 12 otherwise waits for a customer to begin a transaction.

In step 84, input device 32 records a customer choice to begin a film processing transaction.

In step 86, processor 12 causes display 30 to display instructions to customer 40, including photo delivery. Photo delivery options include photo delivery locations and processing times.

In step 88, input device 32 records a customer choice for photo delivery.

In step 90, processor 12 causes display 30 to display payment instructions and payment options.

In step 92, input device 32 records customer choices for payment.

In step 94, processor 12 controls payment modules 18 to record payment.

In step 96, processor 12 causes receipt printer 28 to print a receipt for the customer.

In step 98, processor 12 causes envelope printer and dispenser 16 to print customer choices and customer identification information on a film envelope. Specifically, processor 12 causes envelope printer and dispenser 16 to print identification and location information associated with the delivery location on the envelope. Thus, if the customer plans to pickup photos at the location of apparatus 10, envelope printer and dispenser 16 prints the store identification and location information on the envelope.

In step 100, processor 12 causes envelope printer and dispenser 16 to dispense the envelope.

In step 102, processor 12 causes display 30 to display instructions for filling, closing, and depositing the envelope in collection bin 46. Operation returns to step 82 to wait for another customer.

With the photo delivery information printed on the envelope, the enclosed photos have a better chance of being delivered to the customer. If the envelope were inadvertently delivered to another store, the other store would normally retain the film indefinitely and eventually treat it as unclaimed. After either the envelope has gone unclaimed for a period for time or in response to an inquiry by the customer, the other store can check the envelope to determine whether it was delivered incorrectly. With the delivery location clearly indicated on the envelope, the other store knows with certainty that the film should have been delivered to a different location. The other store will return the envelope to the film processing laboratory. Once returned to the film processing laboratory, the film processing laboratory can contact the customer and make arrangements to deliver the envelope to the customer.

Although the present invention has been described with particular reference to certain preferred embodiments thereof, variations and modifications of the present invention can be effected within the spirit and scope of the following claims.

I claim:

1. A film processing method comprising:

displaying instructions to a customer by an in-store photo processing kiosk, including photo delivery location options during a film processing transaction in a store;

recording a customer choice for a photo delivery location by the kiosk, wherein the photo delivery location is not limited to the store;

printing information identifying the photo delivery location on an envelope for storing undeveloped film by the kiosk; and dispensing the envelope by the kiosk.

2. The method as recited in claim 1, wherein the printing step comprises:

printing a name and an address of the photo delivery location on the envelope by the kiosk.

3. The method as recited in claim 1, wherein the printing step comprises:

printing an identification number associated with the photo delivery location on the envelope by the kiosk.

4. The method as recited in claim 1, further comprising the steps of:

delivering the envelope with developed film to an incorrect photo delivery location by a photo lab;

reading the information identifying the photo delivery location on the envelope at the incorrect photo delivery location; and delivering the envelope to the photo delivery location on the film envelope from the incorrect photo delivery location.

5. A film processing method comprising:

displaying instructions to a customer, including photo delivery location options during a film processing transaction at a first location;

recording a customer choice for a photo delivery location, wherein the photo delivery location is not limited to the first location;

printing information identifying the photo delivery location on a film envelope;

dispensing the envelope to a customer;

depositing the envelope with undeveloped film in an envelope storage bin by the customer;

retrieving and developing the undeveloped film by a film laboratory;

delivering the envelope with developed film to a second location by the film laboratory;

reading the information identifying the photo delivery location on the film envelope; and if the second location is not the photo delivery location on the film envelope, delivering the envelope to the photo delivery location on the film envelope.

6. A film drop-off apparatus comprising:

an in-store kiosk including a computer;

a display controlled by the computer which displays instructions to a customer, including photo delivery location options during a film processing transaction in a store;

an input device controlled by the computer which records a customer choice for a photo delivery location, wherein the photo delivery location is not limited to the store; and a printer controlled by the computer which prints information identifying the photo delivery location on an envelope for storing undeveloped film, and which dispenses the envelope to the customer.

* * * * *